US008282448B2

(12) United States Patent
Loehnert

(10) Patent No.: US 8,282,448 B2
(45) Date of Patent: Oct. 9, 2012

(54) SHARPENING DEVICE FOR KNIFE BLADES

(75) Inventor: Horst Loehnert, Ostfildern (DE)

(73) Assignee: Friedr. Dick GmbH & Co. KG, Deizisau (DE)

( * ) Notice: Subject to any disclaimer, the term of this patent is extended or adjusted under 35 U.S.C. 154(b) by 224 days.

(21) Appl. No.: 12/659,041

(22) Filed: Feb. 24, 2010

(65) Prior Publication Data

US 2010/0227538 A1 Sep. 9, 2010

(30) Foreign Application Priority Data

Mar. 4, 2009 (DE) ..... 10 2009 011 827

(51) Int. Cl.
*B24B 3/54* (2006.01)

(52) U.S. Cl. ..... 451/523; 451/486; 76/86

(58) Field of Classification Search ..... 451/523–525, 451/486, 553, 45; 76/82, 86, 88, 82.2
See application file for complete search history.

(56) References Cited

U.S. PATENT DOCUMENTS 4,627,194 A * 12/1986 Friel ..... 451/163
4,897,965 A 2/1990 Friel
5,440,953 A * 8/1995 Gangelhoff et al. ..... 76/86
5,449,315 A 9/1995 Friel
5,478,272 A * 12/1995 Cozzini et al. ..... 451/540
5,620,359 A * 4/1997 Harrison et al. ..... 451/45
6,726,551 B2 * 4/2004 Friel, Sr. ..... 451/344
6,866,569 B2 3/2005 Cozzini

FOREIGN PATENT DOCUMENTS

| | | |
|---|---|---|
| DE | 10 2006 041 538 | 1/2008 |
| EP | 0 352 823 | 1/1990 |
| EP | 0 381 003 | 8/1990 |

* cited by examiner

*Primary Examiner* — Robert Rose
(74) *Attorney, Agent, or Firm* — Paul Vincent

(57) ABSTRACT

A sharpening device 1 for knife blades comprising a base plate 2 with a guiding slot 6, designed as an incision in the base plate 2, for a knife blade to be sharpened and sharpening rods 10*a*, 10*b* disposed on both sides of the guiding slot 6 to be pivotable against an elastically resilient restoring force, wherein the guiding rods 10*a*, 10*b* intersect at a point of intersection 11 in the area of the guiding slot 6. At least one of the two walls of the base plate 2, which are disposed opposite to each other and form the guiding slot 6, thereby forms a knife abutment surface 7*a*, 7*b* and at least one magnet 20, 21, 22 is mounted to the base plate 2 in the area of the knife abutment surface 7*a*, 7*b*.

9 Claims, 2 Drawing Sheets

SHARPENING DEVICE FOR KNIFE BLADES

This application claims Paris Convention priority of DE 10 2009 011 827.6 filed Mar. 4, 2009 the complete disclosure of which is hereby incorporated by reference.

BACKGROUND OF THE INVENTION

The invention concerns a sharpening device for knife blades, comprising a base plate with a guiding slot formed as an incision in the base plate for a knife blade to be sharpened, and sharpening rods that are disposed on both sides of the guiding slot such that they can be pivoted against an elastically resilient restoring force, wherein the sharpening rods intersect at a point of intersection in the area of the guiding slot.

A sharpening device of this type, which is disclosed e.g. in U.S. Pat. No. 6,866,569 B2 or DE 10 2006 041 538 B3, is used to sharpen and reshape knife blades that have become blunt through use. In order to prevent damage to the base plate, which is usually produced from plastic material, and to prevent soiling of the knife blade as well as of the material cut by the knife blade, e.g. meat, with separated pieces of plastic, metal cut protection elements may be provided in the inlet area of the guiding slot. The sharpening process is performed by disposing the knife blade on the sharpening rods and sharpening the knife blade along the sharpening rods, which follow the motion of the knife blade along the guiding slot. In order to obtain the desired blade quality and exact shape when sharpening a knife blade, the knife blade must generally be repeatedly guided through the sharpening device.

In order to ensure rapid insertion of the blade of a knife into the guiding slot, the guiding slot is substantially wider, at least in one inlet area of its insertion opening, than the knife blade to be sharpened. For this reason, the knife blade is not guided with perfect stability in the guiding slot. This can impair the sharpening result. The sharpening rods moreover only generate a small resistance to the knife blade. The person guiding the knife during sharpening may therefore get the impression (sharpening impression) that the sharpening effect is only small such that the knife blade is guided through the sharpening device an excessive number of times, which is unnecessary and causes increased wear of the knife blade.

It is the underlying purpose of the invention to provide a sharpening device for knife blades, which eliminates the disadvantages of prior art and, in particular, enables stable guidance of the knife blade during sharpening.

SUMMARY OF THE INVENTION

This object is achieved by the sharpening device for knife blades according to the independent claim. The dependent claims represent preferred embodiments of the invention.

The inventive sharpening device for knife blades comprises a base plate with a guiding slot, formed as an incision in the base plate, for a knife blade to be sharpened, and sharpening rods that are disposed on both sides of the guiding slot such that they can be pivoted against an elastically resilient restoring force. The sharpening rods intersect at a point of intersection in the area of the guiding slot.

In accordance with the invention, at least one of the two walls of the base plate, which are disposed opposite to each other and form the guiding slot, is formed as a knife abutment surface and at least one magnet is mounted to the base plate in the area of the knife abutment surface. The magnet may advantageously be e.g. designed as a rectangular magnet and be mounted to the base plate such that its longitudinal axis extends parallel to the knife abutment surface. It is e.g. also possible to mount several magnets to the base plate, which are disposed one behind the other like a band parallel to the knife abutment surface. In particular, permanent magnets are naturally suitable as magnets for use in the inventive sharpening device.

Since knife blades are usually produced from magnetic steel, i.e. steel that is attracted by a magnet, a knife blade that is inserted into the guiding slot to be sharpened is attracted by the magnet in the direction of the knife abutment surface and retained there by means of magnetic force. For this reason, the knife blade is always guided on the knife abutment surface in a defined fashion during sharpening. Irregularities in the guidance of the movements during sharpening are minimized, thereby improving the sharpening result. The person guiding the knife, the blade of which is sharpened, during the sharpening process, feels the attraction between the magnet and the knife blade and a frictional force that is generated between the knife abutment surface and the knife blade. The person thereby gets the same impression as during sharpening of a blade on a sharpening steel. There are also magnetic sharpening steels. The person will therefore tend to reduce the number of times that he/she guides the knife blade through the guiding slot to the required degree to prevent unnecessary wear of the knife blade. The sharpening effect is improved. The magnets retain the generated sharpening dust and the sharpening rods on the sharpening device to prevent them from contaminating the food.

At least one magnet is advantageously mounted to the base plate in the area of each of the two walls of the base plate, which are opposite to each other and form the guiding slot. The magnet(s) mounted in the area of one wall is/are thereby arranged to have a pole orientation repelling the magnet(s) mounted in the area of the other wall. During insertion into the guiding slot, the knife blade is further moved in the direction of one of the walls, since only an unstable state of equilibrium would be possible between the repelling fields. The knife blade, however, is additionally repelled by the magnets that are mounted to the respective opposite wall due to the field induced in the knife blade. This all results in that an increased force acts on the knife blade in the direction of one of the walls. For this reason, the positive effect achieved by the invention can be obtained by smaller, i.e. weaker magnets.

The magnet(s) mounted in the area of one wall thereby advantageously has/have a weaker field strength than the magnet(s) mounted in the area of the other wall. The knife blade is then reliably attracted to the wall with the higher total field strength.

Several magnets are preferably disposed next to each other along the guiding slot at least in the area of one of the walls and/or a rectangular magnet is mounted to the base plate, the longitudinal axis of which extends along the guiding slot. Permanent attraction along the guiding slot is thereby obtained.

When the field strength of the magnets thereby increases from an insertion opening to an area of an end of the guiding slot facing away from the insertion opening, the person guiding the knife can feel when the knife blade has reached the end of the guiding slot facing away from the insertion opening while he/she is guiding the knife blade through the guiding slot. The person will then stop pushing the knife blade further down into the guiding slot, thereby preventing the knife blade from damaging the end of the guiding slot facing away from the insertion opening. The service life of the inventive sharpening device is thereby increased compared to conventional sharpening devices of this type.

In a particularly advantageous variant, pre-positioning means are provided on the base plate, which are designed to fix at least one of the magnets. These pre-positioning means may be designed as simple locking openings for the magnet(s). However, it is also possible to provide a device, which is preferably lockable, for moving a magnet along the guiding slot. In this fashion, any user can position the magnets in a flexible fashion to obtain his/her personal optimum sharpening effect. The magnets may e.g. be positioned in different ways by left-handed and right-handed persons, respectively.

Pre-sharpening elements may moreover be disposed in at least one section of the guiding slot, which follow the shape of the guiding slot at least on the wall of the base plate forming the knife abutment surface. The pre-sharpening elements also utilize the frictional contact that is generated between the knife abutment surface and the knife blade to be sharpened for sharpening the knife blade.

The invention is explained in more detail below by means of an embodiment with reference to the drawings.

DESCRIPTION OF THE PREFERRED EMBODIMENT

Figure 1:
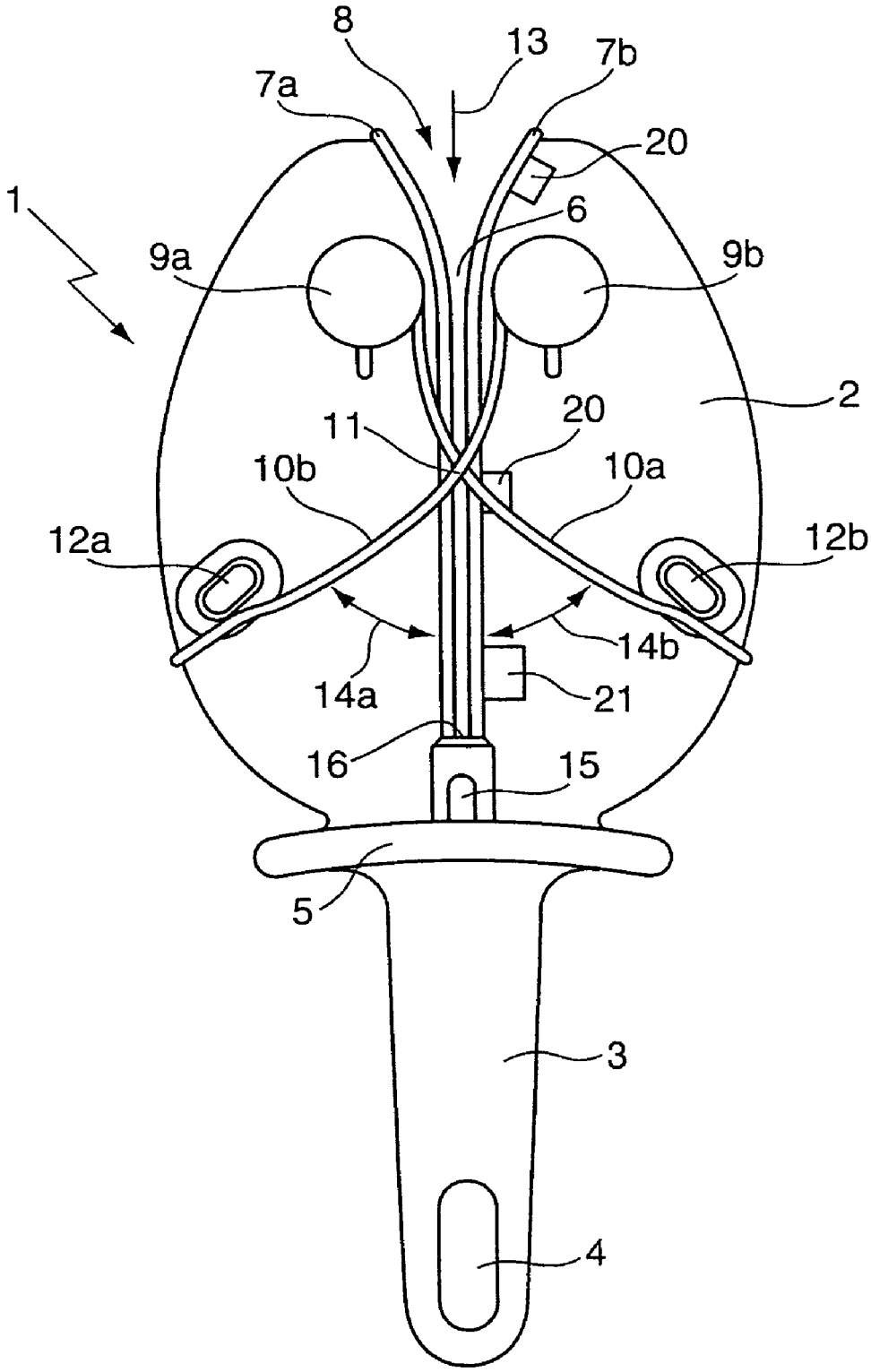
FIG. 1 shows a front side of an inventive sharpening device.

The figures of the drawing show the subject matter of the invention in a highly schematized fashion and are not to be taken to scale. The individual components of the inventive subject matter are illustrated in such a fashion that their construction is clearly visible.

FIG. 1 shows an inventive sharpening device 1 with a substantially oval base plate 2 and a handle 3 that is formed as a handhold and has a recess 4. The dimensions and the material, in the present case plastic material, of the sharpening device 1 are selected in such a fashion that the sharpening device 1 can be held by a user in one hand. A protecting plate 5 is provided between the base plate 2 and the handle 3 for protecting the hand holding the sharpening device 1. A gap-like guiding slot 6 is cut into the base plate 2 and extends over almost its entire length. The guiding slot is formed by two walls of the base plate 2 disposed opposite to each other. Each wall forms a knife abutment surface 7*a* and 7*b*. Towards this end, the thickness of the walls may be larger than the thickness of the base plate 2.

The guiding slot 6 is widened or broadened in an inlet area and forms an insertion opening 8 for the knife blade. Mounting means 9*a* and 9*b* are disposed on both sides of the guiding slot 6, in which sharpening rods 10*a* and 10*b* are pivotably disposed. The sharpening rods 10*a* and 10*b* are disposed in a mirror-inverted fashion with respect to the guiding slot 6 and intersect at a point of intersection 11.

The main sharpening rods 10*a*, 10*b* may be designed in each case as rods extending parallel with respect to each other, such that they engage with each other and intersect in the area of the guiding slot 6 in the illustrated initial position.

In the illustrated initial position, the curved sharpening rods 10*a* and 10*b* abut the upper stops 12*a* and 12*b*. During the entering motion 13 of a knife blade that is guided along the guiding slot 6, the knife blade contacts the sharpening rods 10*a* and 10*b* at the point of intersection 11 and guides them into a final position (not shown). The sharpening rods 10*a* and 10*b* thereby perform pivoting motions 14*a* and 14*b* against a restoring force which is generated by a spring element in the mounting means 9*a* and 9*b*. In the final position, the sharpening rods 10*a* and 10*b* abut a lower stop 15 and the processed or treated knife blade is located at the lower end 16 of the guiding slot 6, i.e. the end facing away from the insertion opening.

In the area of one of the knife abutment surfaces 7*a* and 7*b*, several magnets 20, 21 are mounted to the base plate 2. These magnets 20, 21 are disposed next to each other along the guiding slot 6. When a knife blade to be sharpened is inserted, it is attracted to the associated knife abutment surface 7*b* by the attractive force of the magnet 20 disposed in the inlet area at the insertion opening 8. Due to the fact that several magnets 20, 21 are provided on this knife abutment surface 7*b*, the attractive force to the knife abutment surface 7*b* is continued as the entering movement 13 continues. When the overall guiding slot 6 has been passed from the inlet area to the lower end 16, the knife blade moves along the knife abutment surface 7*b* and along the sharpening rods 10*a* and 10*b*.

The magnet 21 positioned at the lower end of the guiding slot 6 is illustrated somewhat larger than the two other magnets 20. This is to symbolically show that the lower magnet 21 has a higher magnetic field strength than the two other magnets 20. The field strength of the magnets 20, 21 therefore increases from the insertion opening, i.e. from the inlet area 8 to a region of an end 16 of the guiding slot 6 facing away from the insertion opening. The magnets 20, 21 are naturally positioned in such a fashion that they do not spatially collide with the sharpening rods 10*a* and 10*b*. In this connection, the magnets 20, 21 are advantageously mounted to the side of the base plate 2 facing away from the sharpening rods 10*a* and 10*b*.

Figure 2A:
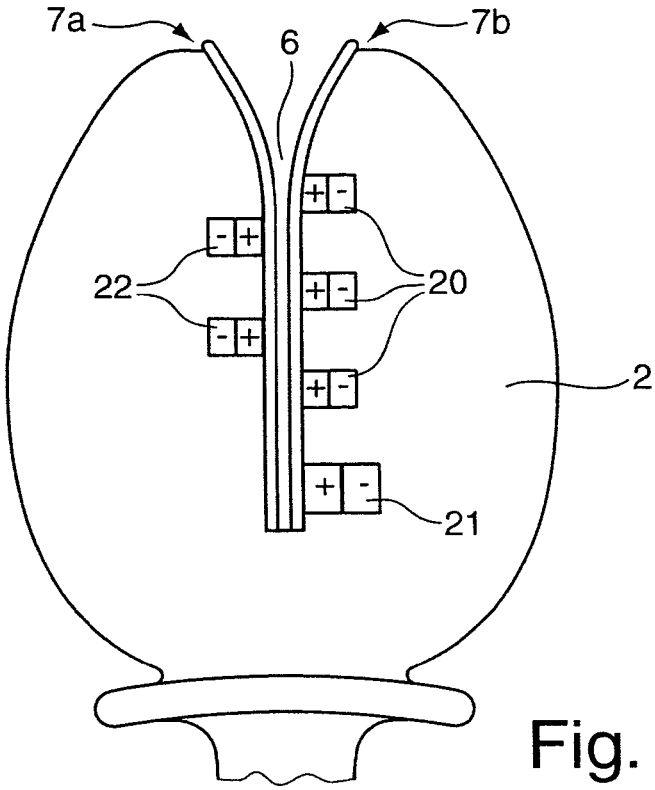
FIGS. 2*a* and 2*b* show the rear side of inventive sharpening devices facing away from the sharpening rods.
Figure 2B:
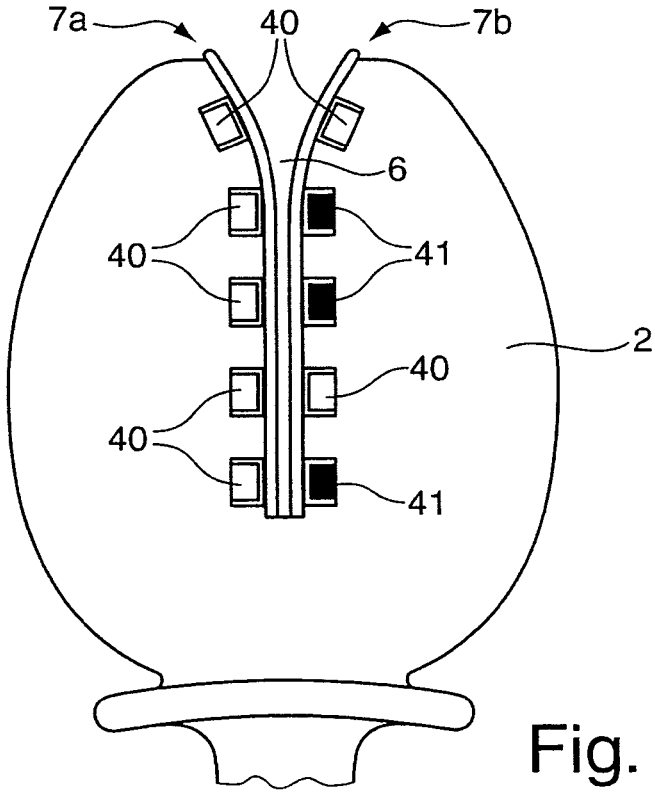

FIGS. 2*a* and 2*b* show the rear side, facing away from the sharpening rods, of inventive sharpening devices with different magnet arrangements.

In FIG. 2*a*, several magnets 20, 21, 22 are mounted in each case to the base plate 2 in the area of both walls that form the guiding slot 6 and are opposite to each other. Only two magnets 22 are thereby disposed on the knife abutment surface 7*a* and four magnets 20, 21 are disposed on the knife abutment surface 7*b*. The poles of the two magnets 22 of the knife abutment surface 7*a* are orientated such that they repel the poles of the four magnets 20, 21 of the knife abutment surface 7*b*. The latter is symbolically shown by the illustrated symbols + and −. The magnets 20, 22 are identical magnets and for this reason, the magnets 22 mounted in the area of the wall of the knife abutment surface 7*a* have an overall smaller field strength than the magnets 20, 21 mounted in the area of the wall of the knife abutment surface 7*b*. The lowermost magnet 21 is shown on an enlarged scale to illustrate its larger magnetic field strength.

The base plate of FIG. 2*b* has pre-positioning means which are designed as receiving holes 40 and are arranged to mount at least one of the magnets 41. Each receiving hole 40 for one magnet is symmetrically disposed in the base plate 2 on both sides of the guiding slot 6 in each case in the area of the knife abutment surfaces 7*a* and 7*b*. One magnet 41 is respectively inserted into three receiving holes 40 in the area of the knife abutment surface 7*b* on the right-hand side of the figure.

The invention proposes a sharpening device 1 for knife blades, comprising a base plate 2 with a guiding slot 6 designed as an incision in the base plate 2 for a knife blade to be sharpened, and sharpening rods 10*a*, 10*b* disposed on both sides of the guiding slot 6 such that they can be pivoted against an elastically resilient restoring force, wherein the sharpening rods 10*a*, 10*b* intersect at a point of intersection 11 in the area of the guiding slot 6.

At least one of the two walls of the base plate 2, which form the guiding slot 6 and are disposed opposite to each other, thereby forms a knife abutment surface 7*a*, 7*b*, and at least one magnet 20, 21, 22, 41 is mounted to the base plate 2 in the area of the knife abutment surface 7*a*, 7*b*.

The invention is not limited to the above-mentioned embodiments but a number of variants are feasible, which utilize the features of the invention although they may have a basically different design.

I claim:

1. A sharpening device for knife blades, the device comprising:

a base plate having a guiding slot structured as an incision in the base plate for a knife blade to be sharpened, wherein the base plate has a first wall and a second wall disposed opposite to said first wall, said first and said second walls defining said guiding slot, at least one of said first and said second walls defining a knife abutment surface;

means for generating an elastically resilient restoring force;

sharpening rods cooperating with and pivoting against said means for generating an elastically resilient restoring force, said guiding rods crossing at a point of intersection in an area of said guiding slot; and at least one magnet, said at least one magnet mounted to said base plate in an area of said knife abutment surface, wherein several magnets are disposed next to each other along said guiding slot, at least in an area of said first wall.

2. The sharpening device of claim 1, wherein a first magnet is mounted to said base plate in an area of said first wall, said first magnet having a first pole.

3. The sharpening device of claim 2, further comprising a second magnet mounted to said base plate in an area of said second wall, said second magnet having a second pole, wherein said first pole repels said second pole.

4. The sharpening device of claim 3, wherein said first magnet has a smaller field strength than said second magnet.

5. The sharpening device of claim 1, wherein a rectangular magnet is mounted to said base plate such that a longitudinal axis thereof extends parallel to and along said guiding slot.

6. The sharpening device of claim 1, wherein a field strength of said several magnets increases from an insertion opening to an area of an end of said guiding slot facing away from said insertion opening.

7. The sharpening device of claim 1, wherein a field strength of said several magnets increases from an insertion opening to an area of an end of said guiding slot facing away from said insertion opening.

8. The sharpening device of claim 1, further comprising pre-positioning means disposed on said base plate, said pre-positioning means structured to mount said at least one magnet.

9. The sharpening device of claim 1, further comprising pre-sharpening elements disposed in at least one section of said guiding slot, said pre-sharpening elements following a shape of said guiding slot at least on a wall of said base plate forming said knife abutment surface.

* * * * *